US006083123A

United States Patent [19]

Wood

[11] Patent Number: 6,083,123

[45] Date of Patent: Jul. 4, 2000

[54] METHOD FOR FITTING GOLF CLUBS FOR GOLFERS

[75] Inventor: Donald C. Wood, Carlsbad, Calif.

[73] Assignee: Zevo Golf Co., Inc., Temecula, Calif.

[21] Appl. No.: 08/799,072

[22] Filed: Feb. 11, 1997

[51] Int. Cl.[7] ..... A63B 53/12

[52] U.S. Cl. ..... 473/409

[58] Field of Search ..... 473/407, 409, 473/289, 219–223, 131, 266; 463/1; 434/252; 364/410.1; 706/45

[56] References Cited

U.S. PATENT DOCUMENTS

| | | | |
|---|---|---|---|
| 4,059,270 | 11/1977 | Sayers | 473/409 |
| 5,351,952 | 10/1994 | Hackman | 473/409 |
| 5,441,256 | 8/1995 | Hackman | 473/409 |
| 5,591,091 | 1/1997 | Hackman | 473/407 X |

*Primary Examiner*—Michael O'Neill
*Attorney, Agent, or Firm*—Higgs, Fletcher & Mack LLP; Bernard L. Kleinke

[57] ABSTRACT

A computer implemented method for fitting golf clubs for golfers to accommodate the swing behavior of an individual's golf swing using combinatorial logic at both the global and local levels. Specifications for a full set of golf clubs are derived from the intersection of two models labeled FITMODEL and SPECPRO. Input data is first gathered (204) and normalized (206) based upon chosen parameters. The chosen parameter relationships are analyzed (208) by FITMODEL, which in turn prescribes specifications (214) for a single reference golf club, preferably a mid-set club such as the 6-iron. SPECPRO uses the chosen parameters to analyze and generate inference (210) expressed as gradient functions—the incremental differences between each club. The gradients are used to specify (222) a full set of clubs.

37 Claims, 4 Drawing Sheets

METHOD FOR FITTING GOLF CLUBS FOR GOLFERS

BACKGROUND OF THE INVENTION

1. Field of the Invention

The present invention relates generally to the fitting of golf clubs to users, and more particularly, to the use of an artificial intelligence expert system to fit golf clubs based upon the primal swing characteristics of a golfer.

2. Description of the Related Art

Artificial intelligence expert systems are computer programs that emulate the behavior of a human expert in a well-bounded domain of knowledge. They have been used in a number of situations, ranging from sheep reproduction management in Australia, hurricane damage assessment in the Caribbean, boiler plant operation in Japan, computer configuration in the United States, and strategic management consulting in Europe. Expert systems technology has been around since the late 1950s, but it has been only since the early 1980's that the commercialization of expert systems has emerged.

An expert system typically has three major components: the dialog structure, inference engine, and knowledge base. The dialog structure is the user interface that allows the user to interact with the expert system. The inference engine is the control structure within the expert system that houses the search strategies to allow the expert system to arrive at various conclusions. The third component is the knowledge base, which is the set of facts and rules of thumb about a specific domain step.

SUMMARY OF THE INVENTION

The present invention is directed to a method, an apparatus, and an article of manufacture that satisfies the need for an expert system to prescribe golf clubs based upon the swing characteristics of the golfer being fitted. In one embodiment of the invention referred to as SETSPEC, two steps are combined in fitting the golf clubs. First, a series of steps labelled FITMODEL prescribe a range of club chemistries for a reference club. Second, a series of steps labelled SPECPRO establishes gradient functions—the incremental differences between each club for specified parameters—that are used to prescribe the remaining clubs of the set. Together, the steps are called SETSPEC and allow a golf professional's thought process to be simulated for fitting golf clubs. Simply Stated, SETSPEC is the intersection of FITMODEL with SPECPRO, or:

$$\text{SETSPEC}=\text{FITMODEL}\cap\text{SPECPRO}$$

SETSPEC works because by using both FITMODEL and SPECPRO, SETSPEC identifies a golfer's tendencies to perform well with one club and underperform with another. With the current invention, every golfer would have their own theoretically "ideal" set of golf clubs. SETSPEC fits all clubs within a set to favor a golfer's swing behavior for each club. No other system for fitting golf clubs to a golfer is known to exist that uses an expert system to prescribe golf clubs.

The SETSPEC steps use combinatorial logic at both the global and local levels. These logical inferences actually parallel the physics of the interaction between the human golf swing and a club. These inferences replace the actual physics of the swing with the logic of an expert system that is knowledgeable in golf swing mechanics, club fitting and golf club construction fundamentals.

Generally, the golf swing or club head orientation input data is deployed into several trilateral and quadrilateral inferences. Each inference is represented by a surface function or a numerically quantified topography (surface plot). These can be the result of Fuzzy Logic, Databases, Spreadsheets or a series of "If—Then" statements quantified by a set of crisp variables, all of which are methods of deduction common to many expert systems.

The method steps begin with receiving input data. The received data is normalized to reflect a test golfer's basic and most predictable tendencies. For example a golfer hitting a series of ten shots will display stochastic behavior for any particular characteristic, designated a "parameter," of the swing. By normalizing the data, aberrant data is eliminated. Any test swing producing aberrant data is not used, assuring that the only input data remaining is for swings where all of the input data falls within a normalized standard deviation. The idea is to isolate swings where the input data, and therefore the respective parameters of the swing, have consistent relationships to one another. This produces a swing profile for the golfer that is likely to hold up over time to within a negligible margin of error. This is known as the "Primal Swing" or the golfer's basic action. The parameters reflecting selected swing characteristics are analyzed and "inferences" are derived from the parameter relationships. These "inferences" are used to describe the test golfers' swing, as described below, using FITMODEL and SPECPRO steps.

FITMODEL

FITMODEL will produce a prescription for a single reference club. FITMODEL is partitioned into several inferences representing the relationship of selected parameters to one or more other selected parameters. Each FITMODEL inference may be a final inference or can be used again in generating another inference. The inferences are based on input data correlating to the shot characteristics of a test golfer's swing. Using these inferences, a golf club is prescribed to help the golfer improve his performance.

For example, a golfer may hit a golf ball too low to attain adequate distance or to stop the ball after it lands on a green. This condition is due to a disproportional relationship of the parameters, club head speed and dynamic loft at impact, where club head speed is the velocity of the club head at the time it impacts the golf ball and dynamic loft is the actual loft of the club head imparted on the golf ball. Because little can be done to greatly increase a golfer's natural club head speed without unpredictable and adverse side affects, the test golfer would be prescribed a club whose club chemistry generates more dynamic loft than a standard club. Once the dynamic loft of the club has been increased, the test golfer's performance will increase.

FITMODEL has numerous such inferences generated by analyzing selected parameter relationships and using the analysis to prescribe a club chemistry. The objective with FITMODEL is to produce a club chemistry so that the interplay of the primal golf swing with the prescribed golf club produces the most desirable and repeatable golf shots.

Additionally, in both theory and practice, most golfers do not need a club which is specified to one specific chemistry. Because club chemistry is defined as the relationship of each club's parameters to another club, it is possible to have a range of club chemistries that could be prescribed without negative results. In other words, a parameter may be changed so long as the interrelating parameters are also adjusted to reflect the change. For any particular golfer there is a range of club chemistries that will work.

The range of club chemistries defines the limits for prescribing a club; an "ideal" club chemistry may be replaced with one having an alternate acceptable club chemistry. For example, consider the parameters below for two 6-irons, each having a different yet acceptable club chemistry, that would result in repeatable and similar swing characteristics for a test golfer:

| | |
|---|---|
| 1. length: 37.5 | lie: 63 | loft: 31.0 | shaft weight: 100 g |
| 2. length: 38.0 | lie 62 | loft 32.0 | shaft weight: 86 g. |

As indicated, the length of each club, the lie angle, the loft angle, and the shaft weight differ for each. Although the two clubs theoretically may not play the same for the test golfer, the differences between the two clubs would be imperceptible to the golfer, that is, both are within an acceptable range of club chemistry. If desired, each individual club of a golf club set could be specified using the FITMODEL method. However, the preferred way to specify the remaining clubs after the "reference" club has been specified is by using SPECPRO.

SPECPRO

Where FITMODEL is ideally used to specify a reference club, SPECPRO establishes the gradients that will ultimately define the remainder of the clubs within a set. SPECPRO operates on the principle that particular club parameters, such as club loft or club flex, must to be adjusted throughout a club set. However, the clubs should maintain a relationship to one another to control shot characteristics such as distance and ball trajectory.

For ease of understanding, the following example is offered to understand the preferred use of SPECPRO with FITMODEL. Assume the test golfer swings a test club ten times, producing a given set of input data. Further assume that industry standards specify that a standard 6-iron be manufactured with a loft of 32 degrees, and that a standard 3-iron be manufactured with a loft of 21 degrees. Based upon the input data generated by the ten test swings, assume further that FITMODEL would also prescribe a 6-iron that has a loft of 32 degrees. Coincidentally, the FITMODEL 6-iron's loft would be equal to the industry standard loft for a 6-iron. But, by using SPECPRO to size the remainder of the clubs for the set, a 3-iron with a loft that differs from the industry standard for a 3-iron could be prescribed. This results because the parameters of the test golfer's swing—specifically the speed and the dynamic loft—which worked together to produce the optimum ball flight with a 6-iron having an industry standard loft could not be linearly extrapolated to clubs with longer shafts ("long irons"). The golfer's club chemistry for the 6-iron is not the same as the golfer's club chemistry for the 3-iron. SPECPRO identifies this difference in club chemistry.

SPECPRO gradients could reflect that the test golfer needs long irons with more loft and shorter irons with less loft than the industry standard. SPECPRO is designed to prescribe a set of clubs which complements the test golfer's unique swing behavior. This is an important feature of the invention because while two golfers may have intersecting chemistries for a given club as prescribed by FITMODEL, their club set chemistries as prescribed by SPECPRO may be vastly different.

Currently, the industry convention is to use set standards to establish the relationships between clubs within a set. Obviously this method has been unsuccessful because most golfers have some clubs within their set that properly fit their primal swing characteristics and other clubs within the same set that do not. Moreover, every manufacturer is seeking the theoretically ideal set chemistry for every golfer. This invention provides the method in which that "ideal" chemistry may be realized.

Additionally, this invention affords its users with a number of other distinct advantages. For example, when the invention is coupled with a data input sensor device such as that contained in U.S. Pat. No. 5,474,298 (Lindsay), which is incorporated herein by reference or otherwise available, a custom set of golf clubs could be expertly fitted to an individual by a quasi-expert or a salesperson at the local golf shop. It would not be necessary to use a golf professional expert. Alternatively, if the evaluations of a golf professional are desired, the invention enhances the golf professional's fitting ability by taking the manually inputted data received from the professional and then establishing a club chemistry range based upon the professional's input data.

BRIEF DESCRIPTION OF THE DRAWING

The objects, advantages and features of the present invention will become better understood to those skilled in the art after considering the following detailed description, when read in conjunction with the accompanying drawing, wherein.

DETAILED DESCRIPTION OF THE PREFERRED EMBODIMENTS

Broadly, the invention concerns a computer implemented expert system for fitting golf clubs to golfers. One particularly advantageous feature of the invention is that every golfer fitted by the invention would have their own theoretically ideal set of golf clubs. The invention automates the fitting process, removing the dependence upon an expert and eliminates inconsistent and subjective outputs.

Hardware Components and Interconnections

Figure 1:
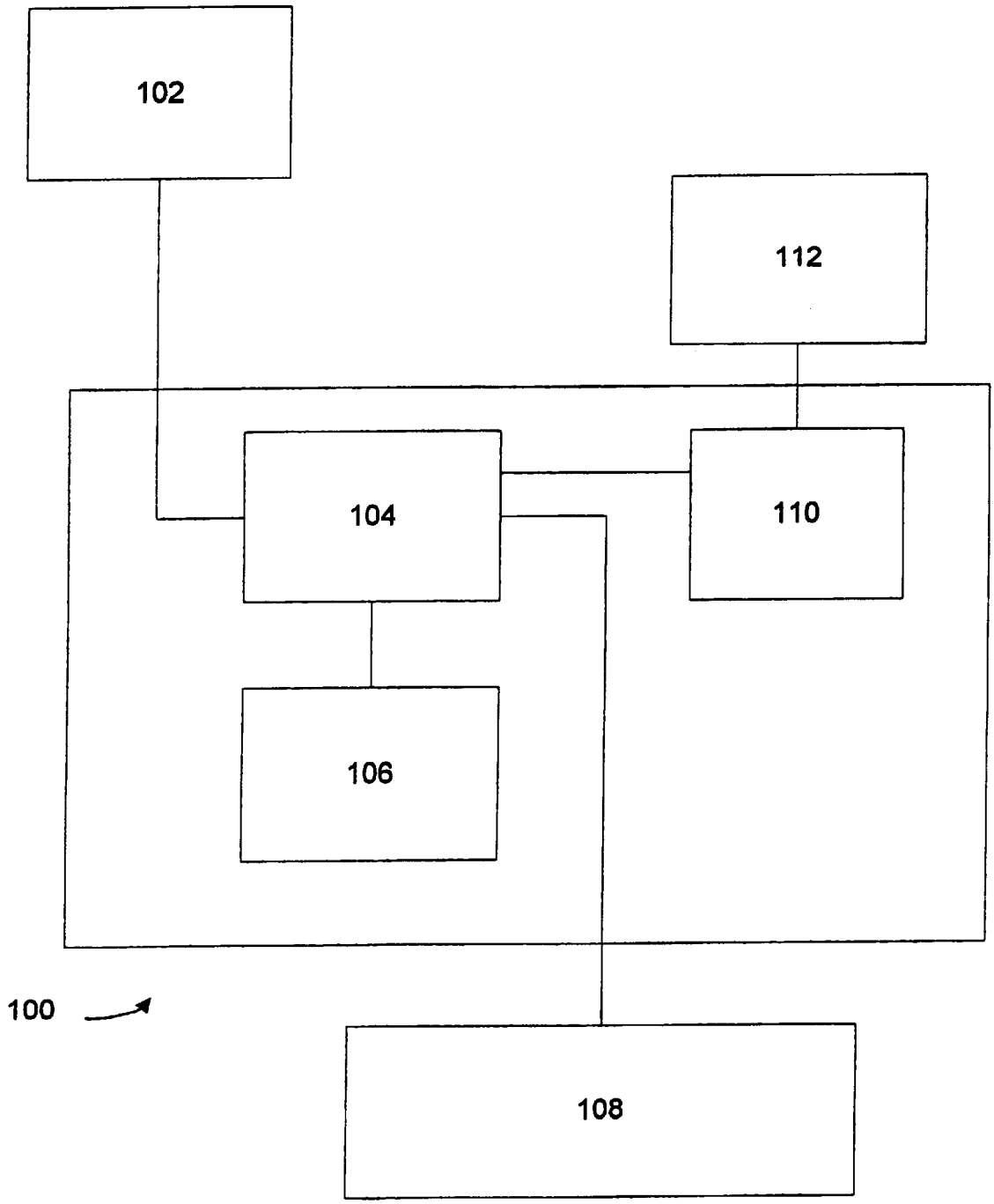
FIG. 1 is a functional block diagram of one embodiment of the invention.

One aspect of the invention concerns a fitting system apparatus, which may be embodied by various hardware configurations. FIG. 1 illustrates one arrangement of the components of a fitting system 100, including various hardware components and interconnections of the system. The system includes input interface 102 for receiving input data, processor 104, and memory 106. As an example, the input interface may receive data from a keyboard, a video camera, electrical sensors, magnetic sensors, or any combination of such sources. The processor may be a microprocessor or the like, and the memory may be a ram or hard drive circuit, or the like.

Processor 104 is electrically connected to input interface 102 which allows data to be received from a data collection source. This source could be a golf professional or other such expert making subjective evaluations and inputing a quantitative number representing his evaluations into fitting system 100 by using a computer keyboard. Alternatively, input interface 102 might receive input data from a golf swing analyzing apparatus as shown in U.S. Pat. No. 5,474,298 (Lindsay) or any other device used to measure golf swing input data that is compatible with the inference engines.

Processor 104 is also electrically connected to memory 106 which assists the processor in performing the steps necessary to execute the fitting system. Processor 104 may also be electrically connected to visual display driver 110, which in turn is electrically connected to visual display 112. Although neither the visual display driver nor visual display are necessary components of the fitting system, a visual display may be desired by the user and is a contemplated addition to fitting system 100.

Output display 108 is electrically connected to processor 104. Output display 108 can be either a printer, a visual display screen, or any other similar device which would allow the individual operating the fitting system to receive the prescription data output by the fitting system.

The electrical connections between the functional elements of the system may be by any suitable means, including by hard wires and wireless means.

Operation

In addition to the various hardware components and interconnections described above, a different aspect of the present invention includes a method to prescribe a "club chemistry" for golf clubs which is reflective of a test golfer's "primal golf swing." The primal golf swing represents the basic action of a golfer's swing, and is produced by analyzing designated parameters of the golfer's swing which have consistent relationships to one another regardless of how many times the golfer swings a given golf club. Other terms to describe the primal golf swing could include "fundamental" or "characteristic."

SETSPEC

Ideally, SETSPEC uses both FITMODEL and SPECPRO steps, working in conjunction with each other, to prescribe a chemistry for a reference club and to prescribe a chemistry profile for the entire golf set. Hence, the sections below discussing FITMODEL and SPECPRO are incorporated by reference in discussing SETSPEC. However, FITMODEL may be used independently from SPECPRO to size each individual club of a set. SPECPRO may also be used independently from FITMODEL if a reference club is otherwise designated.

Figure 2:
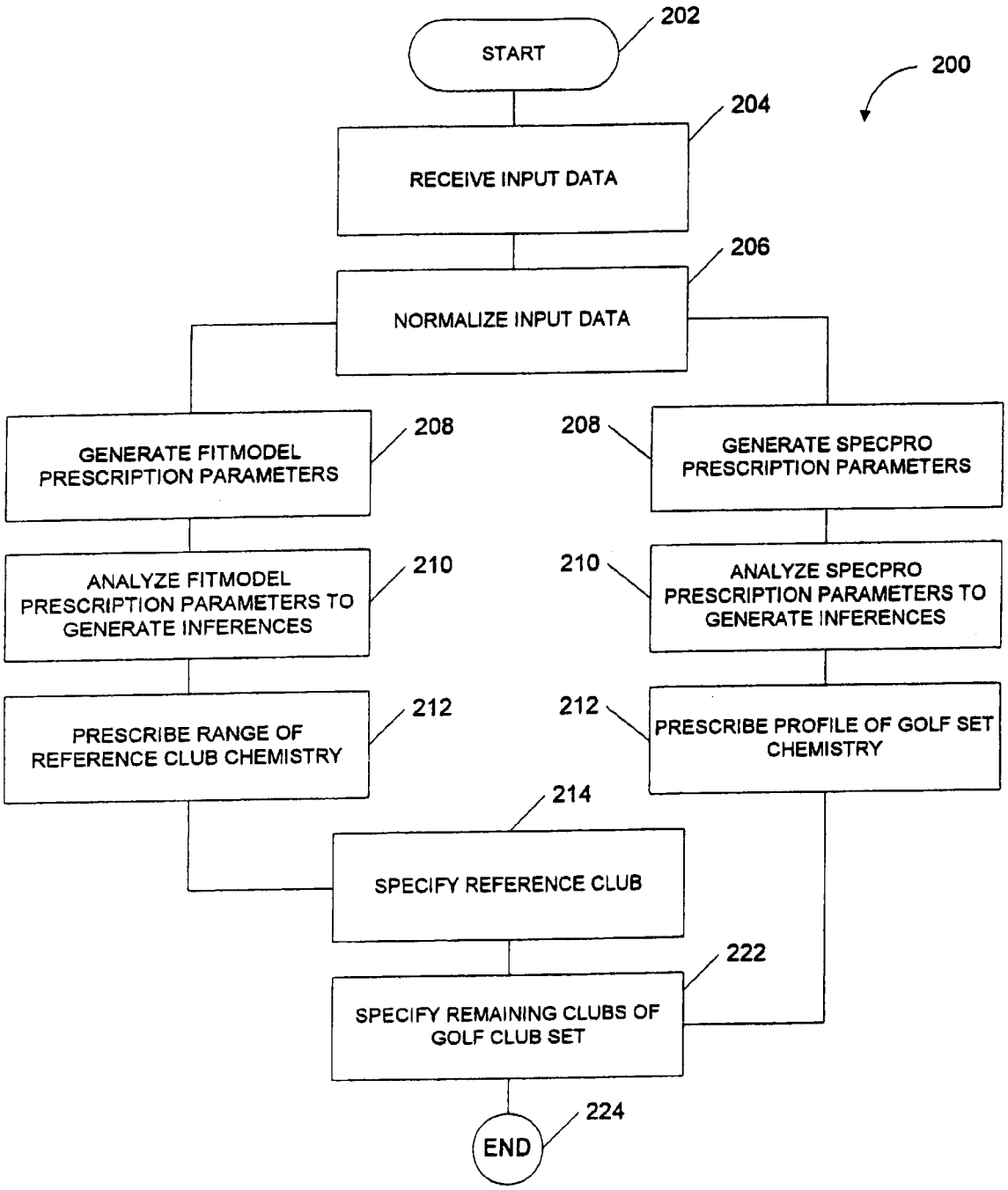
FIG. 2 is a flowchart depicting a sequence of steps for implementing the SETSPEC method of the invention.
Figure 4:
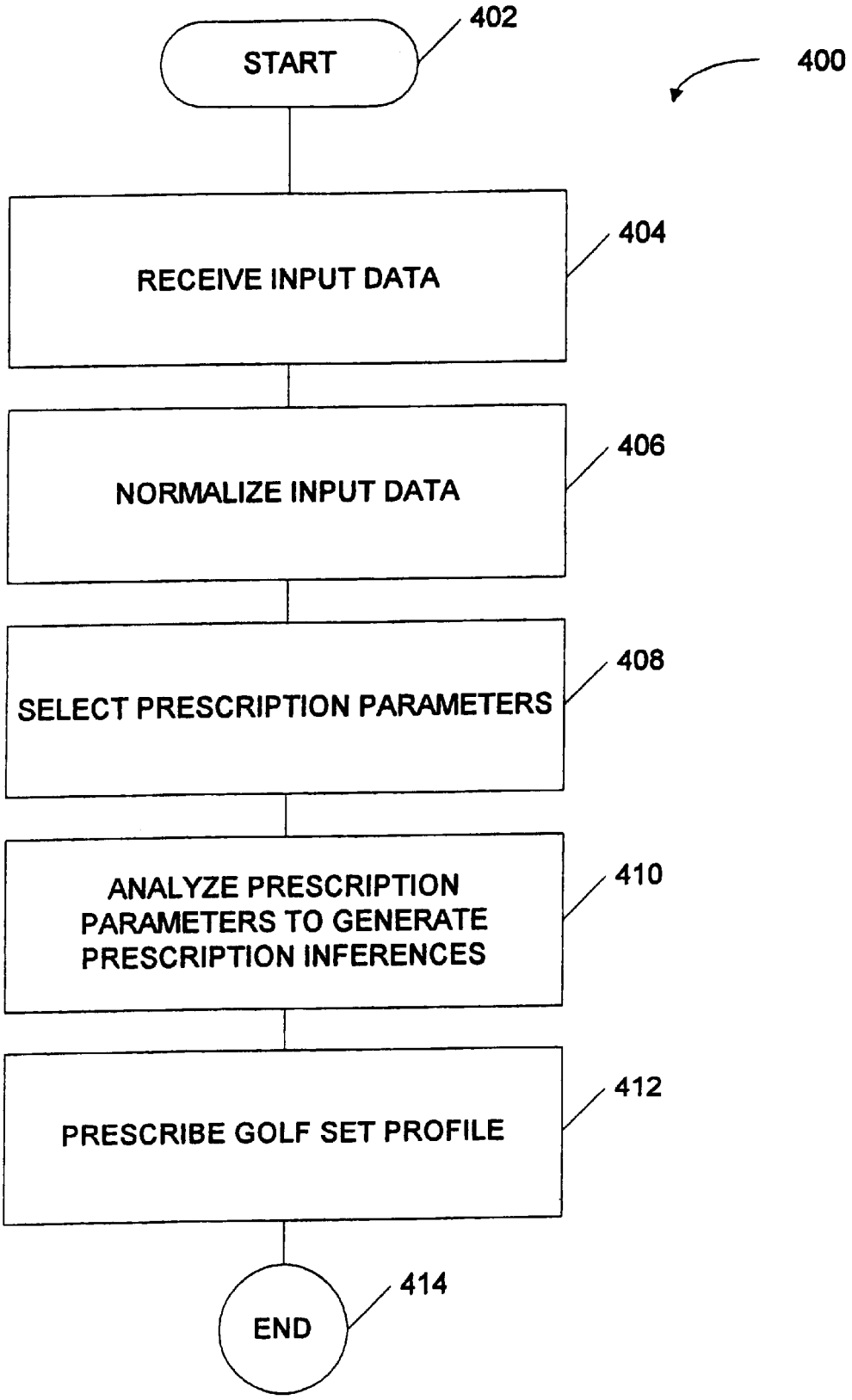
FIG. 4 is a flowchart depicting a sequence of steps for implementing the SPECPRO method of the invention.

FIG. 2 shows a sequence of steps, or SETSPEC routine 200, that illustrates an exemplary embodiment of the SETSPEC method of the invention. Again, for ease of explanation, the following description is made in the context of fitting system 100 illustrated in FIG. 1. However, SETSPEC routine 200 could be adapted to another environment known to an ordinarily skilled artisan having the benefit of this description. FIG. 4 shows that SETSPEC routine 200 begins at start 202. SETSPEC routine 200 is initiated by the operator of fitting system 100 in order to produce both the prescription club chemistry and the club set chemistry.

Ideally, SETSPEC receives input data in step 204 from one or more reliable sensor devices such as described in Lindsay U.S. Pat. No. 5,474,298, or otherwise available from other sources. In the case where no such device exists, the input data can be received from an expert or quasi-expert in the art by inputing the data manually, for example, by using a keyboard, audio input, video input, or the like.

The input data is normalized in step 206 and the prescription parameters selected in step 208, thereafter being analyzed by processor 104. After performing the analysis in step 210 required to profile the logic sequences as stored in memory 106, processor 104 produces the output club chemistry prescription for the reference club and the club set in step 222, displaying the results via output display 108, and completing the fitting process in step 224 by producing a reference club and set prescription. Alternatively, the logic sequences could be imbedded in the processor 104. Output display 108 preferably preserves the club chemistry prescription as a hard copy; however, any suitable device used to display the output club chemistry prescription is acceptable.

FITMODEL

Figure 3:
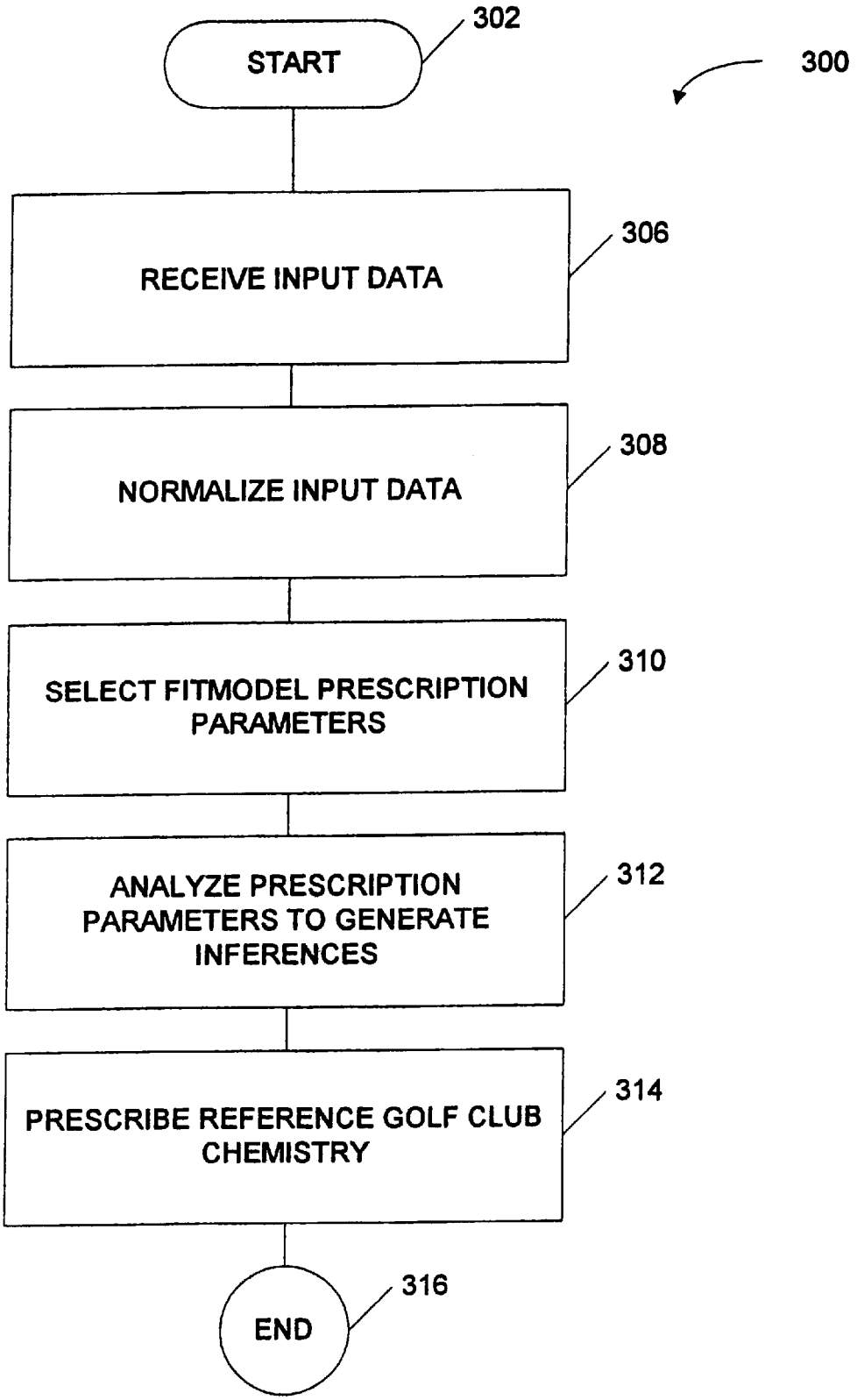
FIG. 3 is a flowchart depicting a sequence of steps for implementing the FITMODEL method of the present invention.

FIG. 3 is a sequence of steps, or FITMODEL routine 300, that shows an exemplary embodiment of the FITMODEL steps of the invention. For ease of explanation, the following description is made in the context of fitting system 100 as shown in FIG. 1. However, FITMODEL routine 300 may be adapted to another environment known to an ordinarily skilled artisan having the benefit of this detailed description.

Generally, FITMODEL routine 300 begins at start 302. In a first embodiment, FITMODEL routine 300 is initiated by the operator of fitting system 100. If the input data is being gathered by a professional golfer making subjective evaluations of a test golfer's swing, numerical or fuzzy numerical values are assigned reflecting the expert's observations of the chosen characteristic. The numerical values are then typed into a keyboard connected to input interface 102, shown in FIG. 1, and is received by processor 104. After performing the analysis of the logic sequences stored in memory 106, or imbedded in the processor, processor 104 then outputs a club chemistry prescription for a reference club via output display 108. The output display preferably preserves the club chemistry prescription as a hard copy; however, any suitable device used to display the output club chemistry prescription is anticipated.

For example, after input data has been received in step 306 by processor 104, task 308 is performed to normalize the input data. Step 308 may be performed by calculating the mean value for the input data for a chosen parameter and determining the data's standard deviation. Any rogue result not falling within a given standard deviation for a swing parameter is eliminated. Any parameter that has data dropped from it during normalization task 308 is filtered out such that the only input data remaining is data which falls within a selected normalized standard deviation. In the preferred embodiment, a multiplicity of input data representing measurements of specific parameters would be received, such as:

1) SPEED (S) data which contains club head speed data at the point of impact with the golf ball for each of the designated test swings;
2) TEMPO (T) data containing data reflecting the time required for the club head to travel from the address position to the point of impact with the golf ball, where the address position is defined as the position of the club head as it rests next to the golf ball prior to the initiation of the test swing;
3) FACE ANGLE (FA) data containing input data representing the golfer's tendency to either hook or slice the golf ball, where an open club face means that the golfer has the tendency to curve the ball from left to right and a closed club face means that the golfer hooks or curves the ball to the left (all directions such as "left" and "right" are from the standpoint of a "right-hand" golfer);
4) DYNAMIC LOFT (DL) data containing input data reflecting the actual loft that the golfer imparts on the golf ball at the point of impact, entered as either as a delta from the test clubs indigenous loft or an absolute value;
5) TRAJECTORY (TR) data containing data relating to the club head's direction vector relative to the horizontal ground plane upon which the test golfer is standing;
6) DYNAMIC LIE (LD) data containing data which represents the difference between the test club's indigenous lie angle and the dynamic lie angle of the test club during a test swing, where the club head's indigenous lie angle is the angle at which the shaft is oriented relative to the club head measured from the vertical axis;

7) ROTATION (R) data containing data correlating to the rotation of the golf club head about the golf club shaft's center axis during a test swing. The club head rotation is used as an assessment of the swing shape and size. Larger swings naturally "rotate" less than smaller swings, wherein swing is defined as the initial movement of the golf club by the golfer to the point of impact with the golf ball. Rotation can indicate a swing condition where the face of the club head rotates either too slowly, thereby "opening up" the club face, or too quickly, thereby "closing up" the club face, where an open club face and a closed club face are as defined above in paragraph 3 defining FACE ANGLE.

8) HEIGHT (H) data containing data correlating to the height of the test subject golfer.

Additional data representing other characteristics could also be received and considered by the system in fitting golf clubs, such as but not limited to: SHOT CHOICE (SC) data which contains a shot preference selection made by the individual being fitted; and SHAFT TYPE (ST) data reflecting the shaft selection choice of the individual test subject, generally a preference of whether the individual desires graphite shafts or steel in his or her golf clubs.

Once step 308 is completed, prescription parameters are selected as shown in step 310. The selection may be controlled by the operator of the fitting system. Alternatively, fitting system 100 may automatically make the selection from memory 106 or using processor 104. After the parameters have been selected, processor 104 analyzes in step 312 the relationships between the specific parameters. These relationships, or inferences, are based upon maximizing the performance of the test subject's individual swing characteristics relative to a particular club specification. As stated previously, the inferences are represented by a surface function or surface plot. In the preferred embodiment, FITMODEL has multiple inferences representing various critical club specifications, where the inference is stated as the intersection ("∩") or union ("∪") of designated parameters:

1) Club shaft flex or "F," measured in cycles per minute, frequency, or the equivalent, is specified as $F=f(F1, F2)$, where $F1=S\cap T$ and $F2=S\cap FA$;

2) Club head's loft angle or "L," measured in degrees, is specified as $L=f(L1,L2)$, where $L1=S\cap DL$ and $L2=DL\cap TR$;

3) Club head's lie angle or "LA," measured in degrees, is specified as $LA=f(LE,EA)$, where $LE=LD\cap H+SC\cap ST$ and $EA=LD+EA_{dc}$, and wherein $EA_{dc}$ is the effective lie angle of the club used to gather data, or test club, and is defined as $EA_{dc}=LE_{dc}\cap LA_{dc}$, wherein $LE_{dc}$ is the length and $LA_{dc}$ is the lie angle of the data club;

4) Club head offset or "OS," measured in inches from the golf club's shaft center line axis to the leading edge of the club face at a right angle to the shaft datum, is specified as $OS=NR\cap FA$, where $NR=H\cup R$;

5) Club head bounce angle or "B," measured in degrees, is specified as $B=DL\cap TR$;

6) Club shaft weight or "W," measured in grams, is specified as $W=((wt_x*W1+wt_y*W2+wt_z*W3)//100)$, where $W1=LE\cap SW$, $W2=S\cap T$, and $W3=S\cap DL$;

7) Club shaft bend point or "BP," measured relative to its positioning on the club shaft, is specified as $BP=S\cap DL$.

8) Club shaft torque or "TQ, " measured in degrees, defines the relationship of $S\cap(NR\cup FA)$, 9) Club swing weight or "SW," measured in inch-ounce, is defined by $f(SW1,SW2)$, where $SW1=H\cap T$ and $SW2=S\cap T$; and 10) Club shaft grip size or "G," measured in inches, is defined by the function $f(G1,G2)$, where $G1=H\cap R$ and $G2=FA\cap R$.

Although certain parameters for the preferred embodiment are discussed above, the inferences can be expanded to include other input parameters such as ball restitution properties, geographic considerations, elevation and the equivalents. As the technology for swing sensor devices improves for collecting swing characteristic measurements, new prescription parameters and inferences will present themselves and can be easily added to FITMODEL.

The inferences generated in step 312 are used to prescribe a club chemistry in step 314. The prescription is used to specify a theoretically ideal golf club matching a test golfer's personal swing characteristics. Step 314 prescribes the golf club chemistry which is displayed by virtue of output display 108, ending the fitting process in step 316.

SPECPRO

Whereas FITMODEL generally specifies one club of a club set, ideally the 6-iron, SPECPRO establishes the gradients that will ultimately define the entire club set. SPECPRO operates on the basis that the club chemistry for each club in a set needs to be adjusted throughout the set to optimize the performance of every club. SPECPRO seeks an ideal fit for all clubs based upon a golfer's swing behavior with only one club, such as the club prescribed by FITMODEL. SPECPRO works because it isolates a golfer's tendencies to perform with one club but not another club of a set by assessing the golfer's primal swing tendencies and assigning the appropriate gradient.

FIG. 4 shows a sequence of steps, or SPECPRO routine 400, that illustrate an exemplary embodiment of the SPECPRO steps of the invention. For ease of explanation, the following description is made in the context of fitting system 100 shown in FIG. 1. However, SPECPRO routine 400 may be adapted to another environment known to an ordinarily skilled artisan having the benefit of this disclosure.

The SPECPRO routine 400 begins in step 402. In one embodiment, input data is received and normalized in steps 404 and 406, respectively, in the same manner as discussed above with respect to FITMODEL steps 306 and 308, respectively. Once steps 404 and 406 are completed, the parameters to be analyzed are selected in step 408. The designation is controlled by the operator of the fitting system, or alternatively, fitting system 100 may automatically make the designation using memory 106 or processor 104. After the parameters have been selected, processor 104 analyzes in step 410 the relationships between the designated parameters. These relationships, or inferences, are based upon the performance of the test golfer's individual swing characteristics, and as indicated in the Summary of the Invention, are represented by a surface function or a numerically qualified topography. In the preferred embodiment, SPECPRO compares designated parameters to generate inferences representing the relationship of each club to each other club within a golf set. The inferences in one embodiment represent the intersection ("∩") or union ("∪") of designated parameters:

1) FREQGRAD, which defines the shaft flex gradient of the set, where $FREQGRAD=f(Fg1,Fg2)$, and where $Fg1=S\cap DL$ and $Fg2=DL\cap TR$;

2) LOFTGRAD, which defines the loft gradient of the set, where LOFTGRAD=$f$(Lg1,Lg2), and where Lg1=S∩DL and Lg2=S∩(DL∪TR); and 3) LIEGRAD which defines the gradient between the lie angles of the various clubs contained within the set, where LIEGRAD=$f$(Lg1,Lg2), and where Lg1=L∩NR and Lg2=NR∩S.

The inferences generated by SPECPRO in step 410 for a set of clubs can be very non-linear. In the preferred embodiment, the inferences are used to generate a prescription in step 412 in the form of a profile. The inferences are expressed in terms of one of the following preferred profiles: Flat Line, which assigns the same specification change from one club to another for the entire set of clubs; Gentle Slope, which assigns a gradual specification change along a gentle incline relative to the prescription and its relationship to a baseline specification; and Steep Slope, which assigns a rigorous change along a steep incline relative to the prescription and its relationship to the baseline specification.

Basically, the FREQGRAD inference seeks to assign shaft flexes for each club of the set so that a golfer has a set of clubs that all "unload" appropriate to their length, weight, and relative function, where "unloading" refers to maximizing the transfer of energy from the club to the golf ball. This "unloading" varies from golfer to golfer because of the golfer's strength, swing motion, rhythm and the golf club's loading behavior.

The LOFTGRAD inference adjusts the loft of each club head so that the optimum loft for a given shot by a given club can be achieved.

The LIEGRAD inference prescribes the lie angles for the club heads. "Shaft droop," a phenomenon that causes the dynamic lie angle to place the head in a more vertical position at the point of impact with the ball indicates that the lie angle may need to be different for each club of the set relative to the baseline lie angle progression. The shaft will bow such that the shaft's profile, when viewed from behind a test golfer, is concave relative to the ground plane upon which the golfer is standing. Because shaft droop is exaggerated by higher head speeds, flatter swing planes, longer clubs, heavier clubs, lighter shaft weights, and more flexible shafts, the clubs' lie angle may need to vary from club to club relative to a normal lie angle progression.

For example, assume that the irons of a club set were being fitted for a test golfer and that a standard baseline progression for shaft frequency, loft, and lie angle, as shown below, is used, where the top number is the iron and the lower number is the baseline specification for the iron:

| 2 | 3 | 4 | 5 | 6 | 7 | 8 | 9 | W | | |
|---|---|---|---|---|---|---|---|---|---|---|
| 2.0 | 2.0 | 2.0 | 2.0 | 2.0 | 2.0 | 2.0 | 2.0 | 2.0 | = | Baseline shaft frequency |
| 18 | 21 | 24 | 28 | 32 | 36 | 40 | 44 | 48 | = | Baseline loft |
| 58 | 59 | 60 | 60.5 | 61.5 | 62.5 | 63.5 | 64.5 | 65.5 | = | Baseline lie angle |

After the test golfer's swing data is received and processed, assume that FITMODEL prescribes a reference 6-iron having a shaft frequency of "2.0," a loft of "32," and a lie angle of "61.5," which coincidentally is the same shaft frequency, lie angle and loft as the baseline reference. If based upon the input data SPECPRO prescribes a FREQGRAD. LOFTGRAD, and LIEGRAD reflecting "Flat Line" profiles, then all iron shaft frequencies, lofts, and lie angles for each club within the set would follow the same gradient or incremental difference as the standard specification profiled above.

But if FITMODEL prescribed a 6-iron with a frequency of "2.0," a loft of 30 or "2 degrees strong" over the baseline specification, and a lie angle of "61.5," and SPECPRO again prescribed a "Flat Line" club set prescription, all irons in the set would have shaft frequencies and lie angles the same as the baseline specifications, but the lofts would be set at "2 degrees strong" over the baseline specification. The clubs lofts prescribed by SPECPRO would be:

| 2 | 3 | 4 | 5 | 6 | 7 | 8 | 9 | W |
|---|---|---|---|---|---|---|---|---|
| 16 | 19 | 22 | 26 | 30 | 34 | 38 | 42 | 46 |

If SPECPRO instead prescribed a club set indicating a "Steep Slope" for the LOFTGRAD inference, then the club loft progression would be:

| 2 | 3 | 4 | 5 | 6 | 7 | 8 | 9 | W |
|---|---|---|---|---|---|---|---|---|
| 20 | 22 | 25 | 28.5 | 32 | 35.5 | 38.5 | 42 | 45 |

representing the steeper gradient required between clubs. The "Steep Slope" prescription requires that the longer-shafted irons have more loft and that the shorter-shafted irons have less loft than the baseline specifications. The difference is that the change relative to baseline is more severe for a "Sleep Slope" profile than it is for a "Flat Line" profile.

The above parameters are analyzed in step 310 and, based upon the inferences therefrom, a golf club set chemistry profile is prescribed in step 312 and displayed by display 108. With present technology the SPECPRO model can be expanded to include several other inferences. Additional inferences can include profile gradients for, but not limited to, such items as BENDPOINT, TORQUE, SWING WEIGHT and SHAFTWEIGHT.

Although the present invention has been described in considerable detail with reference to certain preferred versions thereof, other versions are contemplated. For example, alternative methods for fitting a reference club may exist from which SPECPRO could be used to prescribe the remaining set chemistry. The reference club could be fitted by a golf professional and then could prescribe the remaining clubs. Therefore, the spirit and scope of the appended claims should not be limited solely to the descriptions herein.

What is claimed is:

1. A method for fitting golf clubs implemented by operating a computer to perform steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom; and prescribing a golf club chemistry based upon said inferences.

2. The method of fitting golf clubs recited in claim 1, the normalizing step comprising:

selecting input data corresponding to each chosen parameter;

determining a mean value for said selected input data;

determining a standard deviation for said selected input data;

comparing said selected input data to said mean value for said selected input data; and eliminating any selected input data that is not within said standard deviation of said mean value determined for said selected input data.

3. A method for fitting golf clubs implemented by operating a computer to perform steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom;

prescribing a golf club chemistry based upon said inferences;

wherein said chosen parameters comprise:

a SPEED parameter represented by a SPEED data block, wherein said SPEED data block contains measurements of the golf club head speed at the point of impact with a golf ball;

a TEMPO parameter represented by a TEMPO data block, wherein said TEMPO data block contains measurements of the time required for the club head to travel from the address position to its impact point with the golf ball;

a FACE ANGLE parameter represented by a FACE ANGLE data block, wherein said FACE ANGLE data block contains measurements of the club head face relative to the head's swing path at the point of impact with the golf ball;

a DYNAMIC LOFT parameter represented by a DYNAMIC LOFT data block, wherein said DYNAMIC LOFT data block contains measurements of the actual loft imparted on a golf ball by the club head face at the point of impact with the golf ball, wherein said measurement is taken relative to the ground plane upon which the golfer is standing;

a TRAJECTORY parameter represented by a TRAJECTORY data block, wherein said TRAJECTORY data block contains measurements reflecting the club head's vector relative to the ground plane upon which the golfer is standing;

a DYNAMIC LIE parameter represented by a DYNAMIC LIE data block, wherein said DYNAMIC LIE data block contains measurements reflecting the test club's indigenous lie angle and the test club's dynamic lie angle at the point of impact;

a ROTATION parameter represented by a ROTATION data block, wherein said ROTATION data block contains measurements reflecting the delta from the test club head's static position and the test club head's dynamic position measured as a rotation of the club head about said club shaft's longitudinal axis; and a HEIGHT parameter represented by a HEIGHT data block, wherein said HEIGHT data block contains a measurement of the test golfer's physical height.

4. The method for fitting golf clubs recited in claim 3, wherein said chosen parameters further comprise:

a SHOT CHOICE parameter represented by a SHOT CHOICE data block, wherein said SHOT CHOICE data block contains a subjective choice made by the test golfer as to whether he desires a set that will enhance shot distance or accuracy; and a SHAFT TYPE parameter represented by a SHAFT TYPE data block, wherein said SHAFT TYPE data block contains a subjective choice made by the test golfer as to desired shafting material.

5. The method for fitting golf clubs recited in claim 3, wherein said inferences comprise:

a shaft flex inference, wherein said shaft flex inference comprises the union of a first shaft frequency and a second shaft frequency, wherein said first shaft frequency comprises the intersection of said SPEED parameter and said TEMPO parameter, and wherein said second shaft frequency comprises the intersection of said SPEED parameter and said FACE ANGLE parameter;

a club head loft inference, wherein said club head loft inference comprises the union of a first loft parameter and a second loft parameter, wherein said first loft parameter comprises the intersection of said SPEED parameter and said DYNAMIC LOFT parameter, and wherein said second loft parameter comprises the intersection of said DYNAMIC LOFT parameter and said TRAJECTORY parameter;

a lie angle inference, wherein said lie angle inference comprises the union of a club shaft length parameter and an effective lie angle parameter, said club shaft length parameter comprising the intersection of said DYNAMIC LIE parameter and said HEIGHT parameter plus the intersection of said SHOT CHOICE parameter and said SHAFT TYPE parameter, and wherein said effective lie angle comprises said DYNAMIC LIE parameter plus an effective lie angle parameter for a club used to gather said input data;

an offset inference, wherein said offset inference comprises the union of said NET ROTATION parameter and said FACE ANGLE parameter, and wherein said NET ROTATION parameter comprises the union of said HEIGHT parameter and said ROTATION parameter;

a bounce angle inference, wherein said bounce angle inference comprises the intersection of said DYNAMIC LOFT parameter and said TRAJECTORY parameter;

a swing weight inference, wherein said swing weight inference comprises the union of a first swing weight parameter and a second swing weight parameter, wherein said first swing weight parameter comprises the intersection of said HEIGHT parameter and said TEMPO parameter, and wherein said second swing weight parameter comprises the intersection of said SPEED parameter and said TEMPO parameter;

a shaft weight inference, wherein said shaft weight inference comprises W', wherein $W'=(((wt_x \times W1)+(wt_y \times W2)+(wt_z W3))\div 100)$, and wherein W1 comprises the intersection of said of said LENGTH parameter and said swing weight inference, and wherein W2 comprises the intersection of said SPEED parameter and said TEMPO parameter, and wherein W3 comprises the intersection of said SPEED parameter and said DYNAMIC LOFT parameter;

a bend point inference, wherein said bend point inference comprises the intersection of said SPEED parameter and said DYNAMIC LOFT parameter;

a shaft torque inference, wherein said shaft torque inference comprises the intersection of said SPEED date block with the union of said NET ROTATION parameter and said FACE ANGLE parameter; and a grip size inference, wherein said grip size inference comprises the union of a first grip size parameter and a second grip size parameter, wherein said first grip size parameter comprises the intersection of said HEIGHT parameter and said ROTATION parameter, and wherein said second grip size parameter comprises the intersection of said FACE ANGLE parameter and said ROTATION parameter.

6. An article of manufacture having machine-readable instructions executable by a digital processing apparatus to perform method steps for fitting a golf club, the method steps comprising:

receiving machine readable input data from an input data source wherein said input data includes measurements of parameters for a plurality of swings of a single golf club;

normalizing said input data to eliminate aberrant input data;

choosing parameters;

analyzing the interrelationship of at least two of said chosen parameters to determined inferences therefrom; and prescribing a golf club chemistry based upon said inferences.

7. The article of manufacture recited in claim 6, the normalizing step comprising:

selecting input data corresponding to each chosen parameter;

determining a mean value for said selected input data;

determining a standard deviation for said selected input data;

comparing said selected input data to said mean value for said selected input data; and eliminating any selected input data that is not within said standard deviation of said mean value determined for said selected input data.

8. An article of manufacture having machine-readable instructions executable by a digital processing apparatus to perform method steps for fitting a golf club, the method steps comprising:

receiving machine readable input data from an input data source wherein said input data includes measurements of parameters for a plurality of swings of a single golf club;

normalizing said input data to eliminate aberrant input data;

choosing parameters;

analyzing the interrelationship of at least two of said chosen parameters to determined inferences therefrom;

prescribing a golf club chemistry based upon said inferences;

said chosen parameters comprising:

a SPEED parameter represented by a SPEED data block, wherein said SPEED data block contains measurements of the golf club head speed at the point of impact with a golf ball;

a TEMPO parameter represented by a TEMPO data block, wherein said TEMPO data block contains measurements of the time required for the club head to travel from the address position to its impact point with the golf ball;

a FACE ANGLE parameter represented by a FACE SINGLE data block, wherein said FACE ANGLE data block contains measurements of the club head face relative to the club head's swing path at the point of impact with the golf ball;

a DYNAMIC LOFT parameter represented by a DYNAMIC LOFT data block, wherein said DYNAMIC LOFT data block contains measurements of the actual loft imparted on a golf ball by the club head face at the point of impact with the golf ball, wherein said measurement is taken relative to the ground plane upon which the golfer is standing;

a TRAJECTORY parameter represented by a TRAJECTORY data block, wherein said TRAJECTORY data block contains measurements reflecting the club head's vector relative to the ground plane upon which the golfer is standing;

a DYNAMIC LIE parameter represented by a DYNAMIC LIE data block, wherein said DYNAMIC LIE data block contains measurements reflecting the test club's indigenous lie angle and the test club's dynamic lie angle at the point of impact;

a ROTATION parameter represented by a ROTATION data block, wherein said ROTATION data block contains measurements reflecting the delta from the test club head's static position and the test club head's dynamic position measured as a rotation of the club head about said club shaft's longitudinal axis; and a HEIGHT parameter represented by a HEIGHT data block, wherein said HEIGHT data block contains a measurement of the test golfer's physical height.

9. The article of manufacture recited in claim 8, said chosen parameters further comprising:

a SHOT CHOICE parameter represented by a SHORT CHOICE data block, wherein said SHOT CHOICE data block contains a subjective choice made by the test golfer as to whether he desires a set that will enhance shot distance or accuracy; and a SHAFT TYPE parameter represented by a SHAFT TYPE data block, wherein said SHAFT TYPE data block contains a subjective choice made by the test golfer as to desired shafting material.

10. The article of manufacture recited in claim 8, said inferences comprising:

a shaft flex inference, where in said shaft flex inference comprises the union of a first shaft frequency and a second shaft frequency, wherein said first shaft frequency comprises the intersection of said SPEED parameter and said TEMPO parameter, and wherein said second shaft frequency comprise the intersection of said SPEED parameter and said FACE ANGLE parameter;

a club head loft inference, wherein said club head loft inference comprises the union of a first loft parameter and a second loft parameter, wherein said first loft parameter comprises the intersection of said SPEED parameter and said DYNAMIC LOFT parameter, and wherein said second loft parameter comprises the intersection of said DYNAMIC LOFT parameter and said TRAJECTORY parameter;

a lie angle inference, wherein said lie angle inference comprises the union of a club shaft length parameter and an effective lie angle parameter, said club shaft length parameter comprising the intersection of said DYNAMIC LIE parameter and said HEIGHT parameter plus the intersection of said SHOT CHOICE parameter and said SHAFT TYPE parameter, and wherein said effective lie angle comprises said DYNAMIC LIE parameter plus an effective lie angle parameter for a club used to gather said input data;

an offset inference, wherein said offset inference comprises the union of said NET ROTATION parameter and said FACE ANGLE parameter, and wherein aid NET ROTATION parameter comprises the union of said HEIGHT parameter and said ROTATION parameter;

a bounce angle inference, wherein said bounce angle inference comprises the intersection of said DYNAMIC LOFT parameter and said TRAJECTORY parameter;

a swing weight inference, wherein said swing weight inference comprises the union of a first swing weight parameter and a second swing weight parameter, wherein said first swing weight parameter comprises the intersection of said HEIGHT parameter and said TEMPO parameter, and wherein said second swing weight parameter comprise the intersection of said SPEED parameter and said TEMPO parameter;

a shaft weight inference, wherein said shaft weight inference comprises W', wherein $W'=(((wt_x \times \mathbf{W1})+(wt_y \times \mathbf{W2})+(wt_z \times \mathbf{W3}))\div 100)$, and wherein W1 comprises the intersection of said of said LENGTH parameter and said swing weight inference, and wherein W2 comprises the intersection of said SPEED parameter and said TEMPO parameter, and wherein W3 comprises the intersection of said SPEED parameter and said DYNAMIC LOFT parameter;

a bend point inference, wherein said bend point inference comprises the intersection of said SPEED parameter and said DYNAMIC LOFT parameter;

a shaft torque inference, wherein said shaft torque inference comprises the intersection of said SPEED date block with the union of said NET ROTATION parameter and said FACE ANGLE parameter; and a grip size inference, wherein said grip size inference comprises the union of a first grip size parameter and a second grip size parameter, wherein said first grips size parameter comprises the intersection of said HEIGHT parameter and said ROTATION parameter, and wherein said second grip size parameter comprises the intersection of said FACE ANGLE parameter and said ROTATION parameter.

11. A golf club fitting apparatus, comprising:

a data input interface means for receiving input data;

a memory to store program instructions;

an output display; and a processor coupled to said data input interface, said memory, and said output display, said processor being programmed to perform method steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom; and prescribing golf club chemistry based upon said inferences.

12. The golf club fitting apparatus recited in claim 11, the normalizing of each of said input data blocks to eliminate aberrant data step comprising:

selecting input data corresponding to each chosen parameter;

determining a mean value for said selected input data;

determining a standard deviation of said selected input data;

comparing said selected input data to said mean value for said selected input data; and eliminating any selected input data that is not within said standard deviation of said mean value determined for said selected input data.

13. The golf club fitting apparatus recited in claim 11, the apparatus further comprising:

a display driver coupled to said processor; and a visual display coupled to said display driver.

14. A golf club fitting apparatus, comprising:

a data input interface means for receiving input data;

a memory to store program instructions;

an output display; and a processor coupled to said data input interface, said memory, and said output display, said processor being programmed to perform method steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom;

prescribing golf club chemistry based upon said inferences;

said chosen parameters comprising:

a SPEED parameter represented by a SPEED data block, wherein said SPEED data block contains measurements of the golf club head speed at the point of impact with a golf ball;

a TEMPO parameter represented by a TEMPO data block, wherein said TEMPO data block contains measurements of the time required for the club head to travel from the address position to its impact point with the golf ball;

a FACE ANGLE parameter represented by a FACE ANGLE data block, wherein said FACE ANGLE data block contains measurements of the club head face relative to the club head's swing path at the point of impact with the golf ball;

a DYNAMIC LOFT parameter represented by a DYNAMIC LOFT data block, wherein said DYNAMIC LOFT data block contains measurements of the actual loft imparted on a golf ball by the club head face at the point of impact with the golf ball, wherein said measurement is taken relative to the ground plane upon which the golfer is standing;

a TRAJECTORY parameter represented by a TRAJECTORY data block, wherein said TRAJECTORY data block contains measurements reflecting the club head's vector relative to the ground plane upon which the golfer is standing;

a DYNAMIC LIE parameter represented by a DYNAMIC LIE data block, wherein said DYNAMIC data block contains measurements reflecting the test club's indigenous lie angle and the test club's dynamic lie angle at the point of impact;

a ROTATION parameter represented by a ROTATION data block, wherein said ROTATION data block contains measurements reflecting the delta from the test club head's static position and the test club head's dynamic position measured as a rotation of the club head about said club shaft's longitudinal axis; and a HEIGHT parameter represented by a HEIGHT data block, wherein said HEIGHT data block contains measurements of the test golfer's physical height.

15. The golf club fitting apparatus recited in claim 14, said chosen parameters further comprising:

a SHOT CHOICE parameter represented by a SHOT CHOICE data block, wherein said SHOT CHOICE data block contains a subjective choice made by the test golfer as to whether he desires a set that will enhance shot distance or accuracy; and a SHAFT TYPE parameter represented by a SHAFT TYPE data block, wherein said SHAFT TYPE data block contains a subjective choice made by the test golfer as to desired shafting material.

16. The golf club fitting apparatus recited in claim 14, said inferences comprising:

a shaft flex inference, wherein said shaft flex inference comprises the union of a first shaft frequency and a second shaft frequency, wherein said first shaft frequency comprises the intersection of said SPEED parameter and said TEMPO parameter, and wherein said second shaft frequency comprises the intersection of said SPEED parameter and said FACE ANGLE parameter;

a club head loft inference, wherein said club head loft inference comprises the union of a first loft parameter and a second loft parameter, wherein said first loft parameter comprises the intersection of said SPEED parameter and said DYNAMIC LOFT parameter, and wherein said second loft parameter comprises the intersection of said DYNAMIC LOFT parameter and said TRAJECTORY parameter;

a lie angle inference, wherein said lie angle inference comprises the union of a club shaft length parameter and an effective lie angle parameter, said club shaft length parameter comprising the intersection of said DYNAMIC LIE parameter and said HEIGHT parameter plus the intersection of said SHOT CHOICE parameter and said SHAFT TYPE parameter, and wherein said effective lie angle comprises said DYNAMIC LIE parameter plus an effective lie angle parameter for a club used together said input data;

an offset inference, wherein said offset inference comprises the union of said NET ROTATION parameter and said FACE ANGLE parameter, and wherein said NET ROTATION parameter comprises the union of said HEIGHT parameter and said ROTATION parameter;

a bounce angle inference, wherein said bounce angle inference comprises the intersection of said DYNAMIC LOFT parameter and said TRAJECTORY parameter;

a swing weight inference, wherein said swing weight inference comprises the union of a first swing weight parameter and a second swing weight parameter, wherein said first swing weight parameter comprises the intersection of said HEIGHT parameter and said TEMPO parameter, and wherein said second swing weight parameter comprises the intersection of said SPEED parameter and said TEMPO parameter;

a shaft weight inference, wherein said shaft weight inference comprises W', wherein $W'=(((wt_x \times \mathbf{W1})+(wt_y \mathbf{W2})+(wt_z \times \mathbf{W3}))\div 100)$, and wherein W1 comprises the intersection of said of said LENGTH parameter and said swing weight inference, and wherein W2 comprises the intersection of said SPEED parameter and said TEMPO parameter, and wherein W3 comprises the intersection of said SPEED parameter and said DYNAMIC LOFT parameter;

a bend point inference, wherein said bend point inference comprises the intersection of said SPEED parameter and said DYNAMIC LOFT parameter;

a shaft torque inference, wherein said shaft torque inference comprises the intersection of said SPEED date block with the union of said NET ROTATION parameter and said FACE ANGLE parameter; and a grip size inference, wherein said grip size inference comprises the union of a first grip size parameter and a second grip size parameter, wherein said first grip size parameter comprises the intersection of said HEIGHT parameter and said ROTATION parameter, and wherein said second grip size parameter comprises the intersection of said FACE ANGLE parameter and said ROTATION parameter.

17. A method for fitting golf clubs implemented by operating a computer to perform steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom; and prescribing golf club chemistries based upon said inferences.

18. The method for fitting golf clubs recited in claim 17, the normalizing step comprising:

selecting input data corresponding to each chosen parameter;

determining a mean value for said selected input data;

determining a standard deviation for said selected input data;

comparing said selected input data to said mean value for said selected input data; and eliminating any selected input data that is not within said standard deviation of said mean value determined for said selected input data.

19. A method for fitting golf clubs implemented by operating a computer to perform steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom;

prescribing golf club chemistries based upon said inferences;

said chosen parameters comprising:

a SPEED parameter represented by a SPEED data block, wherein said SPEED data block contains measurements of the golf club head speed at the point of impact with a golf ball;

a TEMPO parameter represented by a TEMPO data block, wherein said TEMPO data block contains measurements of the time required for the club head to travel from the address position to its impact point with the golf ball;

a FACE ANGLE parameter represented by a FACE ANGLE data block, wherein said FACE ANGLE data block contains measurements of the club head face relative to the club head's swing path at the point of impact with the golf ball;

a DYNAMIC LOFT parameter represented by a DYNAMIC LOFT data block, wherein said DYNAMIC LOFT data block contains measurements of the actual loft imparted on a golf ball by the club head face at the point of impact with the golf ball, wherein said measurement is taken relative to the ground plane upon which the golfer is standing;

a TRAJECTORY parameter represented by a TRAJECTORY data block, wherein said TRAJECTORY data block contains measurements reflecting the club head's vector relative to the ground plane upon which the golfer is standing;

a DYNAMIC LIE parameter represented by a DYNAMIC LIE data block, wherein said DYNAMIC data block contains measurements reflecting the test club's indigenous lie angle and the test club's dynamic lie angle at the point of impact;

a ROTATION parameter represented by a ROTATION data block, wherein said ROTATION data block contains measurements reflecting the delta from the test club head's static position and the test club head's dynamic position measured as a rotation of the club head about said club shaft's longitudinal axis; and a HEIGHT parameter represented by a HEIGHT data block, wherein said HEIGHT data block contains measurements of the test golfer's physical height.

20. The method for fitting golf clubs recited in claim 19, said chosen parameters further comprising:

a SHOT CHOICE parameter represented by a SHOT CHOICE data block, wherein said SHOT CHOICE data block contains a subjective choice made by the test golfer as to whether he desires a set that will enhance shot distance or accuracy; and a SHAFT TYPE parameter represented by a SHAFT TYPE data block, wherein said SHAFT TYPE data block contains a subjective choice made by the test golfer as to desired shafting material.

21. The method for fitting golf clubs recited in claim 19, said inferences comprising:

a frequency gradient inference, wherein said frequency gradient inference comprises the union of a first frequency gradient parameter and a second frequency gradient parameter, wherein said first frequency gradient parameter comprises the intersection of said SPEED parameter and said DYNAMIC LOFT parameter, and wherein said second frequency gradient parameter comprises the intersection of said DYNAMIC LOFT parameter and said TRAJECTORY parameter;

a loft gradient inference, wherein said loft gradient inference comprises the union of a first loft gradient parameter and a second loft gradient parameter, wherein said first loft gradient parameter comprises the intersection of said SPEED parameter and said DYNAMIC LOFT parameter, and wherein said second loft gradient parameter comprises the intersection of a parameter comprising a union of said DYNAMIC LOFT parameter and said TRAJECTORY parameter; and a lie gradient inference, wherein said lie gradient inference comprises the union of a first lie gradient parameter and a second lie gradient parameter, wherein said first lie gradient parameter comprises the intersection of said DYNAMIC LIE parameter and said NET ROTATION parameter, said NET ROTATION parameters comprising an intersection of said HEIGHT and said ROTATION parameters, and wherein said second lie gradient parameter comprises the intersection of said SPEED parameter and said NET ROTATION parameter.

22. An article of manufacture having machine-readable instructions executable by a digital processing apparatus to perform method steps for fitting golf clubs, said method steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom; and prescribing golf club chemistries based upon said inferences.

23. The article of manufacture recited in claim 22, the normalizing step comprising:

selecting input data corresponding to each chosen parameter;

determining a mean value for said selected input data;

determining a standard deviation for said selected input data;

comparing said selected input data to said mean value for said selected input data; and eliminating any s elected input data that is not within said standard deviation of said mean value determined for said selected input data.

24. An article of manufacture having machine-readable instructions executable by a digital processing apparatus to perform method steps for fitting golf clubs, said method steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom;

prescribing golf club chemistries based upon said inferences;

said chosen parameters comprising;

a SPEED parameter represented by a SPEED data block, wherein said SPEED data block contains measurements of the golf club head speed at the point of impact with a golf ball;

a TEMPO parameter represented by a TEMPO data block, wherein said TEMPO data block contains measurements of the time required for the club head to travel from the address position to its impact point with the golf ball;

a FACE ANGLE parameter represented by a FACE ANGLE data block, wherein said FACE ANGLE data block contains measurements of the club head face relative to the club head's swing path at the point of impact with the golf ball;

a DYNAMIC LOFT parameter represented by a DYNAMIC LOFT data block, wherein said DYNAMIC LOFT data block contains measurements of the actual loft imparted on a golf ball by the club head face at the point of impact with the golf ball, wherein said measurement is taken relative to the ground plane upon which the golfer is standing;

a TRAJECTORY parameter represented by a TRAJECTORY data block, wherein said TRAJECTORY data block contains measurements reflecting the club head's vector relative to the ground plane upon which the golfer is standing;

a DYNAMIC LIE parameter represented by a DYNAMIC LIE data block, wherein said DYNAMIC data block contains measurements reflecting the test club's indigenous lie angle and the test club's dynamic lie angle at the point of impact;

a ROTATION parameter represented by a ROTATION data block, wherein said ROTATION data block contains measurements reflecting the delta from the test club head's static position and the test club head's dynamic position measured as a rotation of the club head about said club shaft's longitudinal axis; and a HEIGHT parameter represented by a HEIGHT data block, wherein said HEIGHT data block contains measurements of the test golfer's physical height.

25. An article of manufacture having machine-readable instructions executable by a digital processing apparatus to perform method steps for fitting golf clubs, said method steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom;

prescribing golf club chemistries based upon said inferences;

the input data blocks further comprising:

a SHOT CHOICE parameter represented by a SHOT CHOICE data block, wherein said SHOT CHOICE data block contains a subjective choice made by the test golfer as to whether he desires a set that will enhance shot distance or accuracy; and a SHAFT TYPE parameter represented by a SHAFT TYPE data block, wherein said SHAFT TYPE data block contains a subjective choice made by the test golfer as to desired shafting material.

26. The article of manufacture recited in claim 24, said inferences comprising:

a frequency gradient inference, wherein said frequency gradient inference comprise the union of a first frequency gradient parameter and a second frequency gradient parameter, wherein said first frequency gradient parameter comprises the intersection of said SPEED parameter and said DYNAMIC LIFT parameter, and wherein said second frequency gradient parameter comprises the intersection of said DYNAMIC LOFT parameter and said TRAJECTORY parameter;

a loft gradient inference, wherein said loft gradient inference comprises the union of a first loft gradient parameter and a second loft gradient parameter, wherein said first loft gradient parameter comprises the intersection of said SPEED parameter and said DYNAMIC LOFT parameter, and wherein said second loft gradient parameter comprises the intersection of a parameter comprising a union of said DYNAMIC LOFT parameter and said TRAJECTORY parameter; and a lie gradient inference, wherein said lie gradient inference comprises the union of a first lie gradient parameter and a second lie gradient parameter, wherein said first lie gradient parameter comprises the intersection of said DYNAMIC LIE parameter and said NET ROTATION parameter, said NET ROTATION parameter comprising an intersection of said HEIGHT and said ROTATION parameters, and wherein said second lie gradient parameter comprise the intersection of said SPEED parameter and said NET ROTATION parameter.

27. A golf club fitting apparatus, comprising:

a data input interface means for receiving input data;

a memory to perform program instructions;

an output display; and a processor coupled to said data input interface, said memory, and said output display, said processor being programmed to perform method steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom; and prescribing, golf club chemistries based upon said inferences.

28. The method for fitting golf clubs recited in claim 27, the normalizing step comprising:

selecting input data corresponding to each chosen parameter;

determining a mean value for said selected input data;

determining a standard deviation for said selected input data;

comparing said selected input data to said mean value for said selected input data; and eliminating any selected input data that is not within said standard deviation of said mean value determined for said selected input data.

29. The golf club fitting apparatus recited in claim 27, the apparatus further comprising:

a display driver coupled to said processor; and a visual display coupled to said display driver.

30. A golf club fitting apparatus, comprising:

a data input interface means for receiving input data;

a memory to perform program instructions;

an output display; and a processor coupled to said data input interface, said memory, and said output display, said processor being programmed to perform method steps comprising:

receiving machine readable input data from an input data source, wherein said input data comprises measurements of parameters for a plurality of swings of a single golf club;

normalizing said input data to eliminate aberrant input data;

choosing parameters;

analyzing the interrelationship of at least two of said chosen parameters to determine inferences therefrom;

prescribing golf club chemistries based upon said inferences;

said chosen parameters comprising:

a SPEED parameter represented by a SPEED data block, wherein said SPEED data block contains measurements of the golf club head speed at the point of impact with a golf ball;

a TEMPO parameter represented by a TEMPO data block, wherein said TEMPO data block contains measurements of the time required for the club head to travel from the address position to its impact point with the golf ball;

a FACE ANGLE parameter represented by a FACE ANGLE data block, wherein said FACE ANGLE data block contains measurements of the club head face relative to the club head's swing path at the point of impact with the golf ball;

a DYNAMIC LOFT parameter represented by a DYNAMIC LOFT data block, wherein said DYNAMIC LOFT data block contains measurements of the actual loft imparted on a golf ball by the club head face at the point of impact with the golf ball, wherein said measurement is taken relative to the ground plane upon which the golfer is standing;

a TRAJECTORY parameter represented by a TRAJECTORY data block, wherein said TRAJECTORY data block contains measurements reflecting the club head's vector relative to the ground plane upon which the golfer is standing;

a DYNAMIC LIE parameter represented by a DYNAMIC LIE data block, wherein said DYNAMIC data block contains measurements reflecting the test club's indigenous lie angle and the test club's dynamic lie angle at the point of impact;

a ROTATION parameter represented by a ROTATION data block, wherein said ROTATION data block contains measurements reflecting the delta from the test club head's static position and the test club head's dynamic position measured as a rotation of the club head about said club shaft's longitudinal axis; and a HEIGHT parameter represented by a HEIGHT data block, wherein said HEIGHT data block contains measurements of the test golfer's physical height.

31. The golf club fitting apparatus recited in claim 30, said chosen parameters further comprising:

a SHOT CHOICE parameter represented by a SHOT CHOICE data block, wherein said SHOT CHOICE data block contains a subjective choice made by the test golfer as to whether he desires a set that will enhance shot distance or accuracy; and a SHAFT TYPE parameter represented by a SHAFT TYPE data block, wherein said SHAFT TYPE data block contains a subjective choice made by the test golfer as to desired shafting material.

32. The golf club fitting apparatus recited in claim 30, said inferences comprising:

a frequency gradient inference, wherein said frequency gradient inference comprises the union of a first frequency gradient parameter and a second frequency gradient parameter, wherein said first frequency gradient parameter comprises the intersection of said SPEED parameter and said DYNAMIC LOFT parameter, and wherein said second frequency gradient parameter comprises the intersection of said DYNAMIC LOFT parameter and said TRAJECTORY parameter;

a loft gradient inference, wherein said loft gradient inference comprises the union of a first loft gradient parameter and a second loft gradient parameter, wherein said first loft gradient parameter comprises the intersection of said SPEED parameter and said DYNAMIC LOFT parameter and wherein said second loft gradient parameter comprises the intersection of a parameter comprising a union of said DYNAMIC LOFT parameter and said TRAJECTORY parameter; and a lie gradient inference, wherein said lie gradient inference comprises the union of a first lie gradient parameter and a second lie gradient parameter, wherein said first lie gradient parameter comprises the intersection of said DYNAMIC LIE parameter and said NET ROTATION parameter, said NET ROTATION parameter comprising an intersection of said HEIGHT and said ROTATION parameters, and wherein said second lie gradient parameter comprises the intersection of said SPEED parameter and said NET ROTATION parameter.

33. The method for fitting a golf club recited in claim 19, said inferences comprising:

a shaft flex inference, where in said shaft flex inference comprises the union of a first shaft frequency and a second shaft frequency, wherein said first shaft frequency comprises the intersection of said SPEED parameter and said TEMPO parameter, and wherein said second shaft frequency comprise the intersection of said SPEED parameter and said FACE ANGLE parameter;

a club head loft inference, wherein said club head loft inference comprises the union of a first loft parameter and a second loft parameter, wherein said first loft parameter comprises the intersection of said SPEED parameter and said DYNAMIC LOFT parameter, and wherein said second loft parameter comprises the intersection of said DYNAMIC LOFT parameter and said TRAJECTORY parameter;

a lie angle inference, wherein said lie angle inference comprises the union of a club shaft length parameter and an effective lie angle parameter, said club shaft length parameter comprising the intersection of said DYNAMIC LIE parameter and said HEIGHT parameter plus the intersection of said SHOT CHOICE parameter and said SHAFT TYPE parameter, and wherein said effective lie angle comprises said DYNAMIC LIE parameter plus an effective lie angle parameter for a club used to gather said input data;

an offset inference, wherein said offset inference comprises the union of said NET ROTATION parameter and said FACE ANGLE parameter, and wherein aid NET ROTATION parameter comprises the union of said HEIGHT parameter and said ROTATION parameter;

a bounce angle inference, wherein said bounce angle inference comprises the intersection of said DYNAMIC LOFT parameter and said TRAJECTORY parameter;

a swing weight inference, wherein said swing weight inference comprises the union of a first swing weight parameter and a second swing weight parameter, wherein said first swing weight parameter comprises the intersection of said HEIGHT parameter and said TEMPO parameter, and wherein said second swing weight parameter comprise the intersection of said SPEED parameter and said TEMPO parameter;

a shaft weight inference, wherein said shaft weight inference comprises W', wherein $W'=(((wt_x \times \mathbf{W1})+(wt_y \times \mathbf{W2})+(wt_z \times \mathbf{W3}))\div 100)$, and wherein W1 comprises the intersection of said of said LENGTH parameter and said swing weight inference, and wherein W2 comprises the intersection of said SPEED parameter and said TEMPO parameter, and wherein W3 comprises the intersection of said SPEED parameter and said DYNAMIC LOFT parameter;

a bend point inference, wherein said bend point inference comprises the intersection of said SPEED parameter and said DYNAMIC LOFT parameter;

a shaft torque inference, wherein said shaft torque inference comprises the intersection of said SPEED date block with the union of said NET ROTATION parameter and said FACE ANGLE parameter; and a grip size inference, wherein said grip size inference comprises the union of a first grip size parameter and a second grip size parameter, wherein said first grips size parameter comprises the intersection of said HEIGHT parameter and said ROTATION parameter, and wherein said second grip size parameter comprises the intersection of said FACE ANGLE parameter and said ROTATION parameter;

a frequency gradient inference, wherein said frequency gradient inference comprise the union of a first frequency gradient parameter and a second frequency gradient parameter, wherein said first frequency gradient parameter comprises the intersection of said SPEED parameter and said DYNAMIC LIFT parameter, and wherein said second frequency gradient parameter comprises the intersection of said DYNAMIC LOFT parameter and said TRAJECTORY parameter;

a loft gradient inference, wherein said loft gradient inference comprises the union of a first loft gradient parameter and a second loft gradient parameter, wherein said first loft gradient parameter comprises the intersection of said SPEED parameter and said DYNAMIC LOFT parameter, and wherein said second loft gradient parameter comprises the intersection of a parameter comprising a union of said DYNAMIC LOFT parameter and said TRAJECTORY parameter; and a lie gradient inference, wherein said lie gradient inference comprises the union of a first lie gradient parameter and a second lie gradient parameter, wherein said first lie gradient parameter comprises the intersection of said DYNAMIC LIE parameter and said NET ROTATION parameter, said NET ROTATION parameter comprising an intersection of said HEIGHT and said ROTATION parameters, and wherein said second lie gradient parameter comprise the intersection of said SPEED parameter and said NET ROTATION parameter.

34. The article of manufacture recited in claim 24, said inferences comprising:

a shaft flex inference, where in said shaft flex inference comprises the union of a first shaft frequency and a second shaft frequency, wherein said first shaft frequency comprises the intersection of said SPEED parameter and said TEMPO parameter, and wherein said second shaft frequency comprise the intersection of said SPEED parameter and said FACE ANGLE parameter;

a club head loft inference, wherein said club head loft inference comprises the union of a first loft parameter and a second loft parameter, wherein said first loft parameter comprises the intersection of said SPEED parameter and said DYNAMIC LOFT parameter, and wherein said second loft parameter comprises the intersection of said DYNAMIC LOFT parameter and said TRAJECTORY parameter;

a lie angle inference, wherein said lie angle inference comprises the union of a club shaft length parameter and an effective lie angle parameter, said club shaft length parameter comprising the intersection of said DYNAMIC LIE parameter and said HEIGHT parameter plus the intersection of said SHOT CHOICE parameter and said SHAFT TYPE parameter, and wherein said effective lie angle comprises said DYNAMIC LIE parameter plus an effective lie angle parameter for a club used to gather said input data;

an offset inference, wherein said offset inference comprises the union of said NET ROTATION parameter and said FACE ANGLE parameter, and wherein aid NET ROTATION parameter comprises the union of said HEIGHT parameter and said ROTATION parameter;

a bounce angle inference, wherein said bounce angle inference comprises the intersection of said DYNAMIC LOFT parameter and said TRAJECTORY parameter;

a swing weight inference, wherein said swing weight inference comprises the union of a first swing weight parameter and a second swing weight parameter, wherein said first swing weight parameter comprises the intersection of said HEIGHT parameter and said TEMPO parameter, and wherein said second swing weight parameter comprise the intersection of said SPEED parameter and said TEMPO parameter;

a shaft weight inference, wherein said shaft weight inference comprises W', wherein $W'=(((wt_x \times W1)+(wt_y \times W2)+(wt_z \times W3))\div 100)$, and wherein W1 comprises the intersection of said of said LENGTH parameter and said swing weight inference, and wherein W2 comprises the intersection of said SPEED parameter and said TEMPO parameter, and wherein W3 comprises the intersection of said SPEED parameter and said DYNAMIC LOFT parameter;

a bend point inference, wherein said bend point inference comprises the intersection of said SPEED parameter and said DYNAMIC LOFT parameter;

a shaft torque inference, wherein said shaft torque inference comprises the intersection of said SPEED date block with the union of said NET ROTATION parameter and said FACE ANGLE parameter; and a grip size inference, wherein said grip size inference comprises the union of a first grip size parameter and a second grip size parameter, wherein said first grips size parameter comprises the intersection of said HEIGHT parameter and said ROTATION parameter, and wherein said second grip size parameter comprises the intersection of said FACE ANGLE parameter and said ROTATION parameter;

a frequency gradient inference, wherein said frequency gradient inference comprise the union of a first frequency gradient parameter and a second frequency gradient parameter, wherein said first frequency gradient parameter comprises the intersection of said SPEED parameter and said DYNAMIC LIFT parameter, and wherein said second frequency gradient parameter comprises the intersection of said DYNAMIC LOFT parameter and said TRAJECTORY parameter;

a loft gradient inference, wherein said loft gradient inference comprises the union of a first loft gradient parameter and a second loft gradient parameter, wherein said first loft gradient parameter comprises the intersection of said SPEED parameter and said DYNAMIC LOFT parameter, and wherein said second loft gradient parameter comprises the intersection of a parameter comprising a union of said DYNAMIC LOFT parameter and said TRAJECTORY parameter; and a lie gradient inference, wherein said lie gradient inference comprises the union of a first lie gradient parameter and a second lie gradient parameter, wherein said first lie gradient parameter comprises the intersection of said DYNAMIC LIE parameter and said NET ROTATION parameter, said NET ROTATION parameter comprising an intersection of said HEIGHT and said ROTATION parameters, and wherein said second lie gradient parameter comprise the intersection of said SPEED parameter and said NET ROTATION parameter.

35. The golf club fitting apparatus recited in claim 30, the prescription parameters comprising:

a shaft flex inference, where in said shaft flex inference comprises the union of a first shaft frequency and a second shaft frequency, wherein said first shaft frequency comprises the intersection of said SPEED parameter and said TEMPO parameter, and wherein said second shaft frequency comprise the intersection of said SPEED parameter and said FACE ANGLE parameter;

a club head loft inference, wherein said club head loft inference comprises the union of a first loft parameter and a second loft parameter, wherein said first loft parameter comprises the intersection of said SPEED parameter and said DYNAMIC LOFT parameter, and wherein said second loft parameter comprises the intersection of said DYNAMIC LOFT parameter and said TRAJECTORY parameter;

a lie angle inference, wherein said lie angle inference comprises the union of a club shaft length parameter and an effective lie angle parameter, said club shaft length parameter comprising the intersection of said DYNAMIC LIE parameter and said HEIGHT parameter plus the intersection of said SHOT CHOICE parameter and said SHAFT TYPE parameter, and wherein said effective lie angle comprises said DYNAMIC LIE parameter plus an effective lie angle parameter for a club used to gather said input data;

an offset inference, wherein said offset inference comprises the union of said NET ROTATION parameter and said FACE ANGLE parameter, and wherein aid NET ROTATION parameter comprises the union of said HEIGHT parameter and said ROTATION parameter;

a bounce angle inference, wherein said bounce angle inference comprises the intersection of said DYNAMIC LOFT parameter and said TRAJECTORY parameter;

a swing weight inference, wherein said swing weight inference comprises the union of a first swing weight parameter and a second swing weight parameter, wherein said first swing weight parameter comprises the intersection of said HEIGHT parameter and said TEMPO parameter, and wherein said second swing weight parameter comprise the intersection of said SPEED parameter and said TEMPO parameter;

a shaft weight inference, wherein said shaft weight inference comprises W', wherein $W'=(((wt_x \times W1)+(wt_y \times W2)+(wt_z \times W3))\div 100)$, and wherein W1 comprises the intersection of said of said LENGTH parameter and said swing weight inference, and wherein W2 comprises the intersection of said SPEED parameter and said TEMPO parameter, and wherein W3 comprises the intersection of said SPEED parameter and said DYNAMIC LOFT parameter;

a bend point inference, wherein said bend point inference comprises the intersection of said SPEED parameter and said DYNAMIC LOFT parameter;

a shaft torque inference, wherein said shaft torque inference comprises the intersection of said SPEED date block with the union of said NET ROTATION parameter and said FACE ANGLE parameter; and a grip size inference, wherein said grip size inference comprises the union of a first grip size parameter and a second grip size parameter, wherein said first grips size parameter comprises the intersection of said HEIGHT parameter and said ROTATION parameter, and wherein said second grip size parameter comprises the intersection of said FACE ANGLE parameter and said ROTATION parameter;

a frequency gradient inference, wherein said frequency gradient inference comprise the union of a first frequency gradient parameter and a second frequency gradient parameter, wherein said first frequency gradient parameter comprises the intersection of said SPEED parameter and said DYNAMIC LIFT parameter, and wherein said second frequency gradient parameter comprises the intersection of said DYNAMIC LOFT parameter and said TRAJECTORY parameter;

a loft gradient inference, wherein said loft gradient inference comprises the union of a first loft gradient parameter and a second loft gradient parameter, wherein said first loft gradient parameter comprises the intersection of said SPEED parameter and said DYNAMIC LOFT parameter, and wherein said second loft gradient parameter comprises the intersection of a parameter comprising a union of said DYNAMIC LOFT parameter and said TRAJECTORY parameter; and a lie gradient inference, wherein said lie gradient inference comprises the union of a first lie gradient parameter and a second lie gradient parameter, wherein said first lie gradient parameter comprises the intersection of said DYNAMIC LIE parameter and said NET ROTATION parameter, said NET ROTATION parameter comprising an intersection of said HEIGHT and said ROTATION parameters, and wherein said second lie gradient parameter comprise the intersection of said SPEED parameter and said NET ROTATION parameter.

36. An apparatus for fitting golf clubs to a golfer, comprising:

means for receiving machine readable input data from an input data source, wherein said input data comprises measurements or parameters for a plurality of swings of a single golf club;

means for normalizing said input data to eliminate aberrant input data;

means for choosing parameters;

means for analyzing the interrelationship of at least two of said chosen parameters to determine inferences therefrom; and means for prescribing a golf club chemistry based upon said inferences.

37. A method for prescribing a set of golf clubs for a golfer, the method comprising:

using parameters indicative of the golfer's golf club swing;

characterizing a primal swing for the golfer responsive to the parameters;

determining a range of club characteristics for a reference club responsive to the determined characteristics, the reference club being one club in the set of clubs; and prescribing additional clubs for the golf club set by defining incremental parameter differences from the reference club.

* * * * *